United States Patent [19]

Seragnoli

[11] 3,989,199

[45] Nov. 2, 1976

[54] APPARATUS WITH A ROTATABLE HEAD FOR SUPPLYING CIGARETTES TO THE INFEED HOPPERS ON HIGH SPEED CIGARETTE PACKETING MACHINES

[75] Inventor: Enzo Seragnoli, Bologna, Italy

[73] Assignee: G. D. Societa per Azioni, Italy

[22] Filed: Mar. 17, 1975

[21] Appl. No.: 558,917

[30] Foreign Application Priority Data

Apr. 8, 1974 Italy ..... 3347/74

[52] U.S. Cl. ..... 214/302

[51] Int. Cl.[2] ..... B65F 3/02

[58] Field of Search ..... 214/301, 302, 312, 314; 53/148

[56] References Cited

UNITED STATES PATENTS

| | | | |
|---|---|---|---|
| 3,190,478 | 6/1965 | Schermund | 214/307 |
| 3,486,647 | 12/1969 | Seragnoli | 214/312 X |
| 3,655,080 | 4/1972 | Gianese | 214/307 X |

*Primary Examiner*—Leon Gilden
*Attorney, Agent, or Firm*—Robert E. Burns; Emmanuel J. Lobato; Bruce L. Adams

[57] ABSTRACT

Apparatus for supplying cigarettes to a high speed packeting machine in an automatic fashion by sequentially discharging containers filled with cigarettes into the supply hopper of the machine. A parallelepiped box shaped head is rotatable around a horizontal shaft above the hopper. The head comprises two end walls connected to each other by a wall and by battens so as to create two opposite cavities open at one end wall and along one side, where the opening provides a discharge mouth. Containers of cigarettes are inserted, one upside down with respect to the other, each with its open top positioned by the aforementioned discharge mouth. The head is placed so that while one cavity has its discharge mouth located for dropping the cigarettes into the supply hopper, the other cavity is laterally lined up with one of the containers, halted on a conveyor belt. A back square or angle stop member either closes or opens the discharge mouth. This member is operated by levers, guides, actuators and return springs. The full containers of cigarettes are carried from the conveyor belt to the rotatable head by a transverse transfer belt structure and once they have been emptied, the same structure attends to their return to the belt. A full container of cigarettes is placed in a first cavity in the rotatable head, at the time a second cavity has in it a container that is being emptied. Once the cigarettes have been discharged, the head is reversed while the discharge mouth of the first cavity is opened.

3 Claims, 5 Drawing Figures

APPARATUS WITH A ROTATABLE HEAD FOR SUPPLYING CIGARETTES TO THE INFEED HOPPERS ON HIGH SPEED CIGARETTE PACKETING MACHINES

BACKGROUND OF THE INVENTION

This invention relates to the field of technology for packeting cigarettes by means of high speed packeting machines and, to be more precise, has as its subject an apparatus with a rotatable head for supplying cigarettes to an infeed hopper of a high speed cigarette packeting machine.

DESCRIPTION OF THE PRIOR ART

As is known, the current practice for cigarettes produced on cigarette making machines is for them to be transferred to the packeting machines in containers of a width substantially identical to the length of the cigarettes, open either at one side or at the front and top, inside which the cigarettes are accumulated and placed parallel with one another.

When containers of this nature, with an open side, are filled up with cigarettes, they are taken to a packeting machine for an operator to manually mount them individually, as required, onto a frame rotatable around a horizontal shaft, in such a way that their open side is placed against a wall in the frame.

The operator then wraps a strip of flexible material, usually fastened at one end to the frame, around the top of the container duly positioned on the frame or else he places a rod, known as a "bayonet" over it; causes the frame to rotate around its horizontal shaft and to tip the container downwards above the infeed hopper of the packeting machine, with its top either enwrapped in the strip of flexible material or sealed with the bayonet; withdraws the strip of flexible material, or the bayonet from between the upper level of the cigarettes already in the hopper and the lower level of the cigarettes contained in the upside down container, in such a way as to allow the cigarettes to drop down inside the hopper; and, finally, when all the cigarettes in the container have fallen into the hopper, he causes the frame to rotate in the opposite direction to that in which it moved previously and then removes the empty container.

When acting in the manner described above, it often happens that as the strip of flexible material or the bayonet is manually withdrawn, the cigarettes directly affected by such withdrawal are moved out of their normal position of parallelism with one another and with downward pointing channels, provided in the hopper, into a transverse position. This impedes their descent through the channels. Once the channels are empty, considerable trouble results, as is well known to technicians who work in this particular field. There are frequent prolonged breaks in production or, at the very least, a lack of continuity in the operation of the packeting machine.

Similar problems are, above all, also encountered when there is a progressive increase in the distance the cigarettes in the containers have to drop for them to reach the level of the infeed cigarettes already contained in the hopper, due to even a slight delay on the part of the operator in carrying out the above mentioned procedure for infeeding full containers and removing those which have been emptied, or when the packeting machines are of the type that run at a high unit output speed, causing the level of the cigarettes being infed from the inside of the hopper to drop very quickly. This, for example, occurs with the cigarette packeting machine according to U.S. Pat. No. 3,628,309 assigned to the present assignees.

SUMMARY OF THE INVENTION

The object of the present invention is to overcome the problems resulting from an increase in the distance the cigarettes must drop from the containers, overturned above the hopper, to reach the level of the infeed cigarettes already contained in the hopper; also to overcome the problems occasioned by inconstancy in the rhythm at which manual operations of discharging the filled containers and removing the empty ones are performed, or by said level being lowered at a fast rate when high unit output speed packeting machines are used; and to make available an apparatus for charging the hoppers of packeting machines, which is able to rapidly replace, in an automatic fashion, empty containers above the hoppers with full containers.

A further object of the present invention is to make available a similar apparatus provided with a rotatable charging head located above the hopper to be filled, shaped in such a way as to be able to accept in it two containers in opposite symmetrical or mirror-image positions, one position placing the respective container upside down for supplying the cigarettes to the hopper, with sensor means being provided to detect when the container has been emptied and to consequentially set the rotatable charging head in motion in order to reverse the positions of the two containers so that the empty container be immediately replaced with a full container and that the empty container be removed and substituted with a full container while the container previously placed in the discharging position is emptying.

These and other objects too have all been attained with the apparatus according to the invention for supplying cigarettes to the infeed hoppers on high speed cigarette packeting machines, on which the cigarettes are grouped together in containers of a width substantially equal to the length of the cigarettes, open either at one side or at the front, the containers being aligned parallel with one another in Indian file on at least one conveyor belt moving in a succession of steps. According to the invention the apparatus comprises a box shaped head rotatably movable around a horizontal shaft and having at least one pair of opposite cavities having an aperture at least on one side and along the top, the latter aperture providing a discharge mouth. The cavities are designed to accept containers of cigarettes in mirror image position relative to one another, one upside down with respect to the other, the top of a container being positioned by the discharge mouth. The apparatus provides movable means supported by the box-shaped head for opening and closing each discharge mouth; transfer means that engage with one container at a time for removing it from the conveyor belt to within a cavity in the movable head and from another cavity therein back to the conveyor belt, respectively; means for operating the transfer means; means for causing the movable head to rotate around its horizontal shaft in such a way as to reverse the mirror-image positions of the containers housed in the corresponding cavities; means for operating the movable means which open and close the discharge mouths; and electromechanical means connected to the means for operating the transfer means, the means for operating the rotatable head, the movable means for opening and closing the discharge mouths, and the conveyor belt, in a succession of steps in a cyclic synchronized phase relationship.

DESCRIPTION OF THE PREFERRED EMBODIMENT

Figure 1:
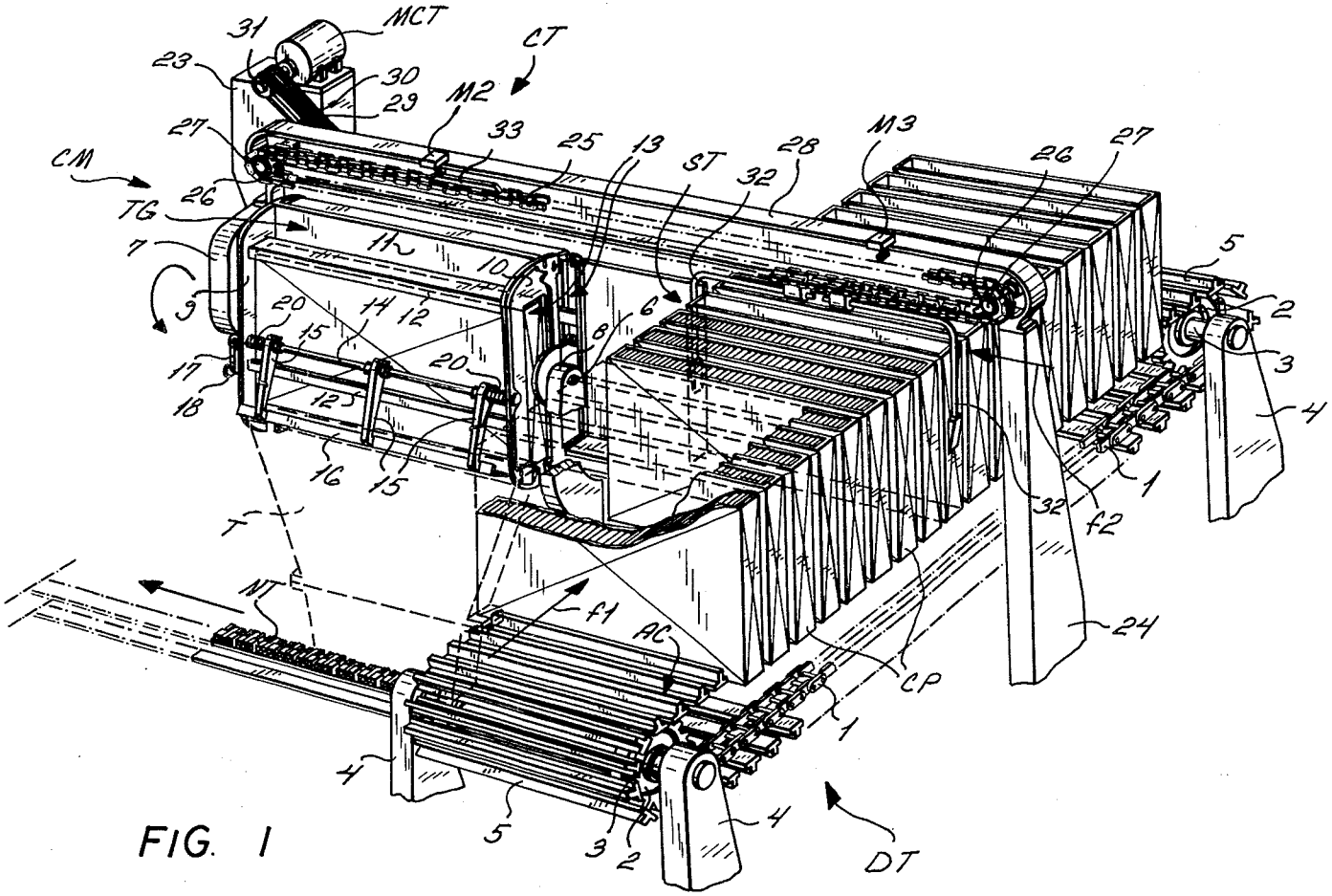
FIG. 1 diagrammatically shows the apparatus according to the invention in a perspective view.
Figure 2:
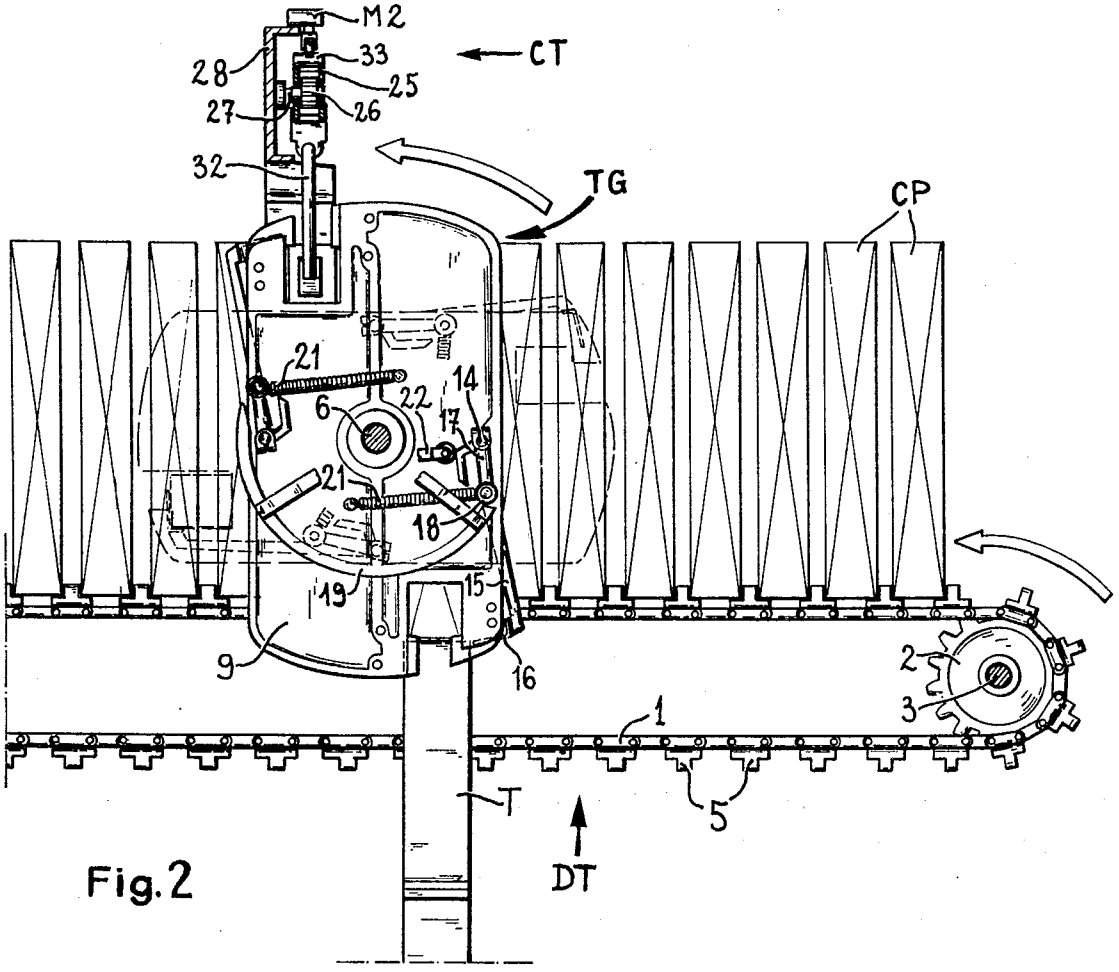
FIG. 2 diagrammatically shows the new apparatus as seen from the left side in FIG. 1.

From FIGS. 1 and 2 it can be seen that the new apparatus comprises a conveyor system generally designated DT which, in turn, is constituted by a conveyor belt fundamentally determined by two endless chains 1 parallel with each other, which turn over sprocket wheels 2 mounted on a horizontal shaft 3 carried by a supporting structure, the upright members 4 of which are shown in FIG. 1. The chains 1 are transversely interlinked by means of battens 5 which are spaced away from one another at distances slightly greater than the depth of a container CP for cigarettes, so as to form a succession of housings AC for containers, CP.

A contrivance generally designated CM for handling the containers and supplying the cigarettes to a packeting machine, is placed along a vertical plane perpendicular to the said conveyor belt (see the lefthand side of FIG. 1) between the belt and the packeting machine to be supplied, parts of which are visible in FIG. 1.

The parts of the packeting machine which are shown in FIG. 1 are the supply hopper T and beneath it, the conveyor belt NT for the batches of cigarettes to be supplied to the packeting machine for packeting them in accordance with a previously established technique, as outlined in other Patents of the Assignees hereof.

The contrivance CM comprises a generally box shaped, essentially parallelepiped, head TG (see also FIG. 3) rotatably mounted on a horizontal shaft 6 carried by supports 7 and 8 above hopper T in a way that will be understood better in due course. The rotatable head TG consists fundamentally of two end walls 9 and 10 interconnected by a middle wall 11 transverse to end walls 9, 10; and, on each side opposite to the wall 11, interconnected by battens 12 parallel to middle wall 11; so as to create two opposite cavities 13. Each cavity 13 is open at the side 10. Each cavity is also open along one long side of head TG to provide a discharge mouth. Each cavity is designed to hold one container CP of cigarettes in an upside-down mirror-image position with respect to the other, with the containers top part located where the discharge mouth runs.

A rotatable head TG of this nature is placed vertically in such a way that either cavity 13 (looking at FIG. 1) can be disposed with the discharge mouth thereof above the supply hopper T instead. This cavity will be called the front cavity. The other or; rear cavity is laterally lined up with one of the housings AC halted, with the conveyor belt at a standstill, in a position hereinafter referred to as the transfer station ST (see FIG. 1).

On the outside of each cavity 13, a shaft 14 is carried rotatably by the end walls 9 and 10 and this, in turn, carries a plurality of fixed arms 15, the free end of which is integral with a member 16 providing a back square or angle stop.

Figure 3:
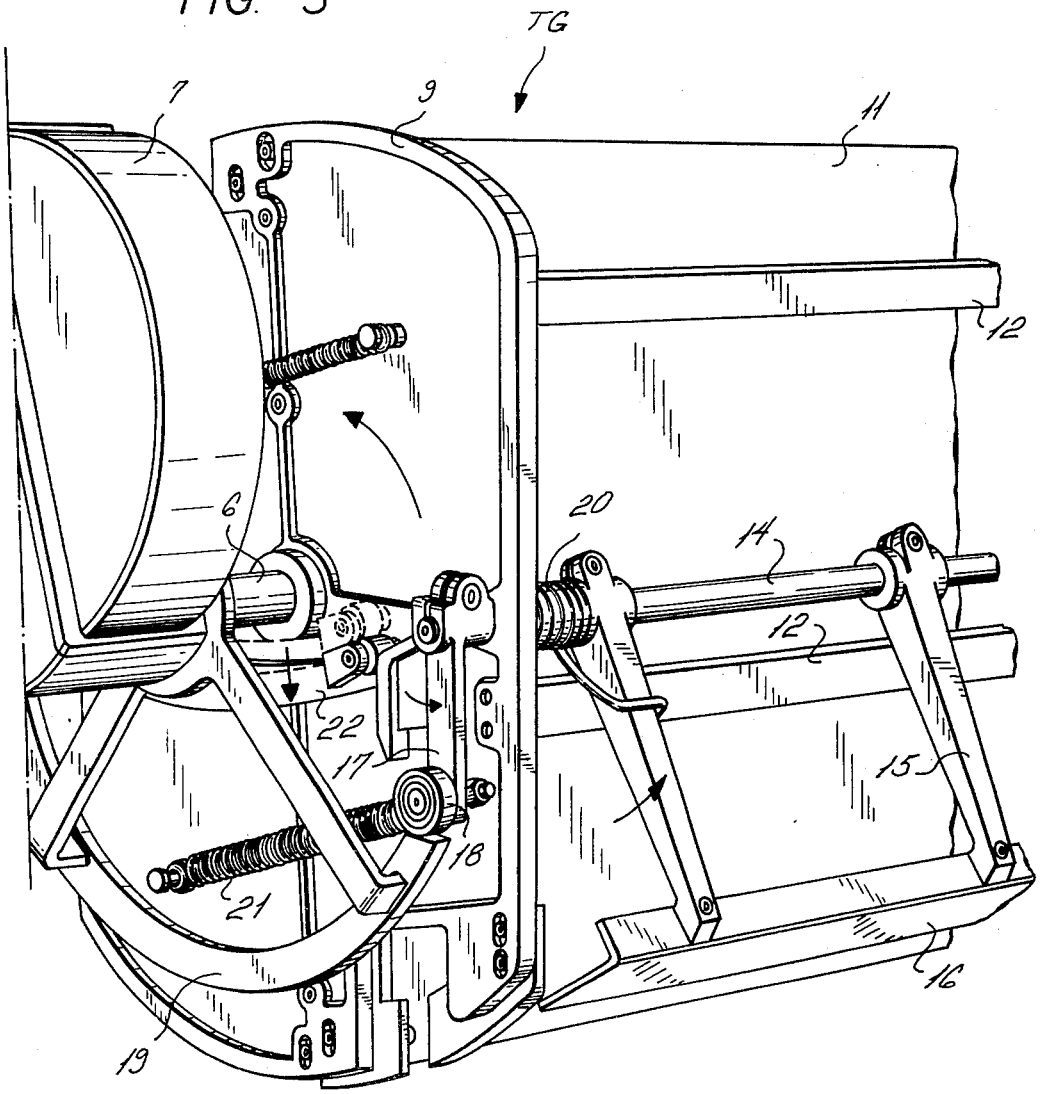
FIG. 3 shows, in a perspective view and in an enlarged form, one part of the new apparatus.

Mounted, cantilever fashion, on the end of the shaft 14 externally on the side 9 there is a lever 17 and the end of this is provided with an idle roller 18 which can engage with an arcuate guide rail 19 fixedly carried by the support 7 (see FIG. 3). Torsion springs 20 threaded onto the shaft 14 and anchored at opposite ends to the end walls 9 and 10 and to two of the arms 15, respectively; in addition tension springs 21 may be anchored at opposite ends to the end walls 9 and 10 and to the free end of the lever 17. Both sets of springs normally tend to cause the shaft 14 to oscillate so as to carry the back square member 16 towards the middle wall 11 into a position whereby the discharge mouth of the cavity is sealed. A counter force to the springs is provided as will be described now.

The support 7 carries an oscillating feeler arm 22 which is designed to operate the lever 17 in order to carry the aforementioned back square member 16 in opposition to the pressure exerted by the springs 20 and 21, from the cavity sealing position (FIG. 2) to the cavity spring position shown in FIG. 3 and thereby to allow the cigarettes to be discharged from the supply container into the supply hopper T. The actuation of arm 22 will be described in the following description of the operation of the apparatus.

Above the rotatable head TG and belt 1 a container transferring contrivance generally designated CT is supported, for example by means of pillars 23 and 24 (see FIG. 1) by the structure carrying the apparatus. This contrivance consists essentially of an endless chain 25 running over idle wheels 26 on horizontal spindles 27 rotatably carried by the aforementioned pillars 23 and 24 through a partial casing 28 in which the said chain 25 is housed.

One of the horizontal spindles 27 has keyed onto it a transmission pulley 29 driven through a drive belt 30 by a transmission pulley 31 keyed onto the drive shaft of an electric motor MCT carried by the aforementioned pillar 23.

A lower run of the chain 25 has connected to it a transfer device with downward pointing vertical arms 32, while the upper run of chain 25 carries a cam 33 that works in conjunction with the tripping mechanisms of two micro limit switches M2 and M3 carried on the aforementioned casing 28. The distance between the two arms 32 can be set to accept a container CP lengthwise and the positioning of the micro limit switches M2 and M3 is also adjustable.

Reference will now be made to the wiring diagram, FIG. 4, and to FIG. 5 which shows the time-phase graph in respect of one operating cycle of the moving parts.

Diagrammatically shown in the said wiring diagram are the rotatable head TG, the supply hopper T for infeeding cigarettes and between one and the other, a sensor consisting of a lamp l projecting a ray of light *r* towards a photoelectric cell *cf* so positioned that it is hit by the ray of light *r* when, as will be seen, the cigarettes supplied to the hopper T have dropped to a level below that of the ray of light *r*.

Furthermore, the sensor cell *cf* is provided with an amplifier 34 for which a microcontact 35, movable from an open position 1–3 to a closed position 1–2, is depicted. The amplifier 34 is connected to a microswitch 36 with two contacts movable from an open position 1–4 and 2–6, respectively, to a closed position 1–3 and 2–5, respectively. The microswitch 36 is, in turn, connected to a device 37 for manually setting and cutting off the automatic cyclic operation of the apparatus.

Figure 4:
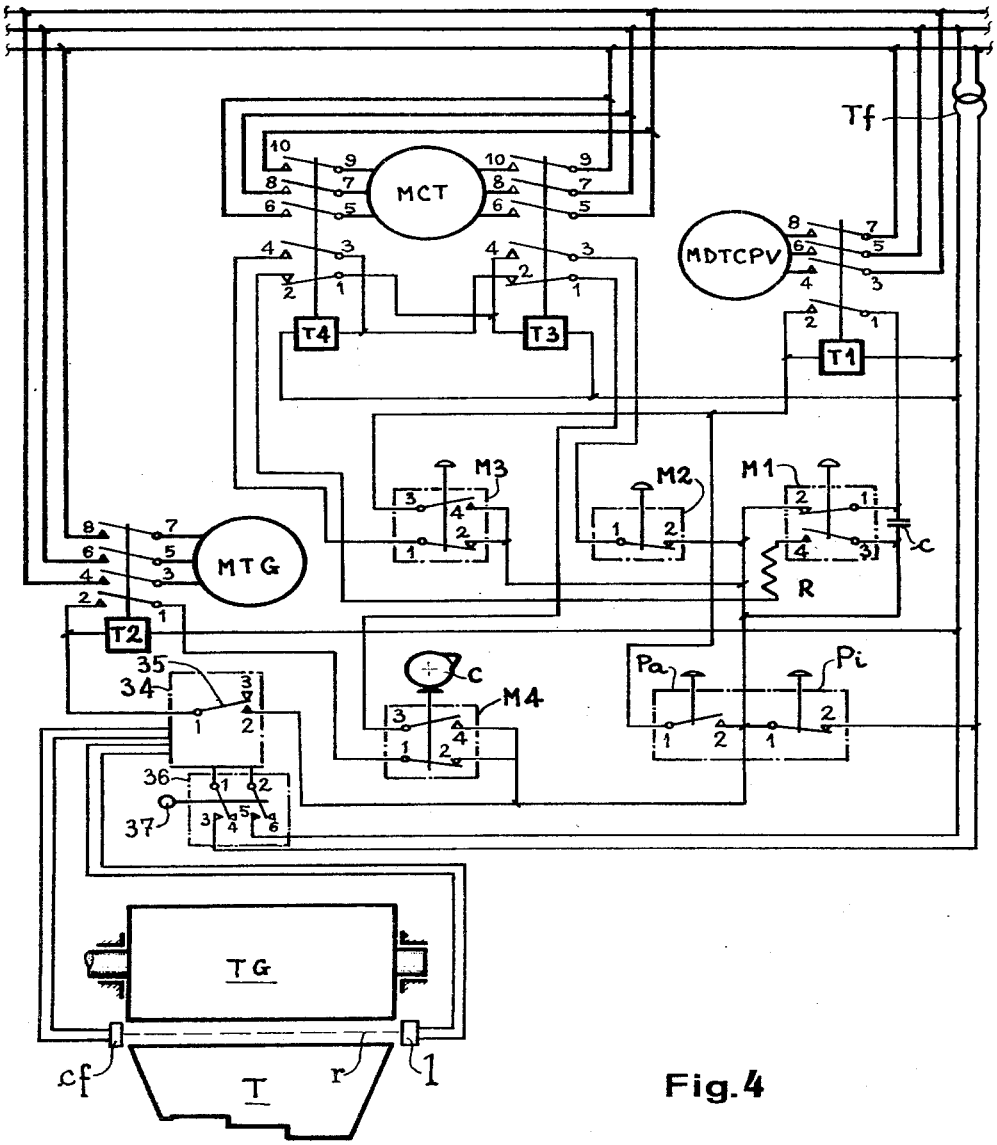
FIG. 4 is a wiring diagram for the new apparatus.

FIG. 4 also shows the electric motor MDTCPV, for causing the conveyor system DT to move in a succession of steps; the previously mentioned electric motor MCT, for powering the transfer contrivance CT; the electric motor MTG, for moving the rotatable head TG; and the multiple contact motor protection contactors for each motor, shown individually as T1, T3–T4 and T2. Also shown therein are the micro limit switches M2 and M3; a microswitch M1 (not shown in FIG. 1) providing a sensor, between the position or station ST of the conveyor system DT and the position immediately prior to the former in the forward direction in which the conveyor system DT moves, marked in FIG. 1 with the arrow *f*1; pushbutton switches comprising two contacts, P*a* and P*i*, respectively, the former normally open for manually setting the apparatus in motion and the latter, normally closed for stopping it, also manually; a cyclic cam C for actuating a mechanism that operates a double contact microswitch M4; and an electric transformer T*f* with a 24 volt output for supplying the aforementioned electrical components.

The operation of the above described apparatus takes place in the following way:

Assuming, first of all, that the apparatus is at a standstill with the ray of light *r* from the sensor broken by the mass of cigarettes passing from the rotatable head TG into the supply hopper T,; that the apparatus has been set ready to operate automatically in a cyclic fashion with the contacts of the microswitch 36 closed because of the device 37 having been manually put in the right position; and that on the conveyor system DT, prior to the transfer station ST, full containers of cigarettes CP are duly positioned in their housings AC, while in and after the said station ST, there are empty containers of cigarettes; if then the pushbutton of the contact P*a* is depressed, the contactor T1 is excited through the normally closed safety contact P*i*.

Figure 5:
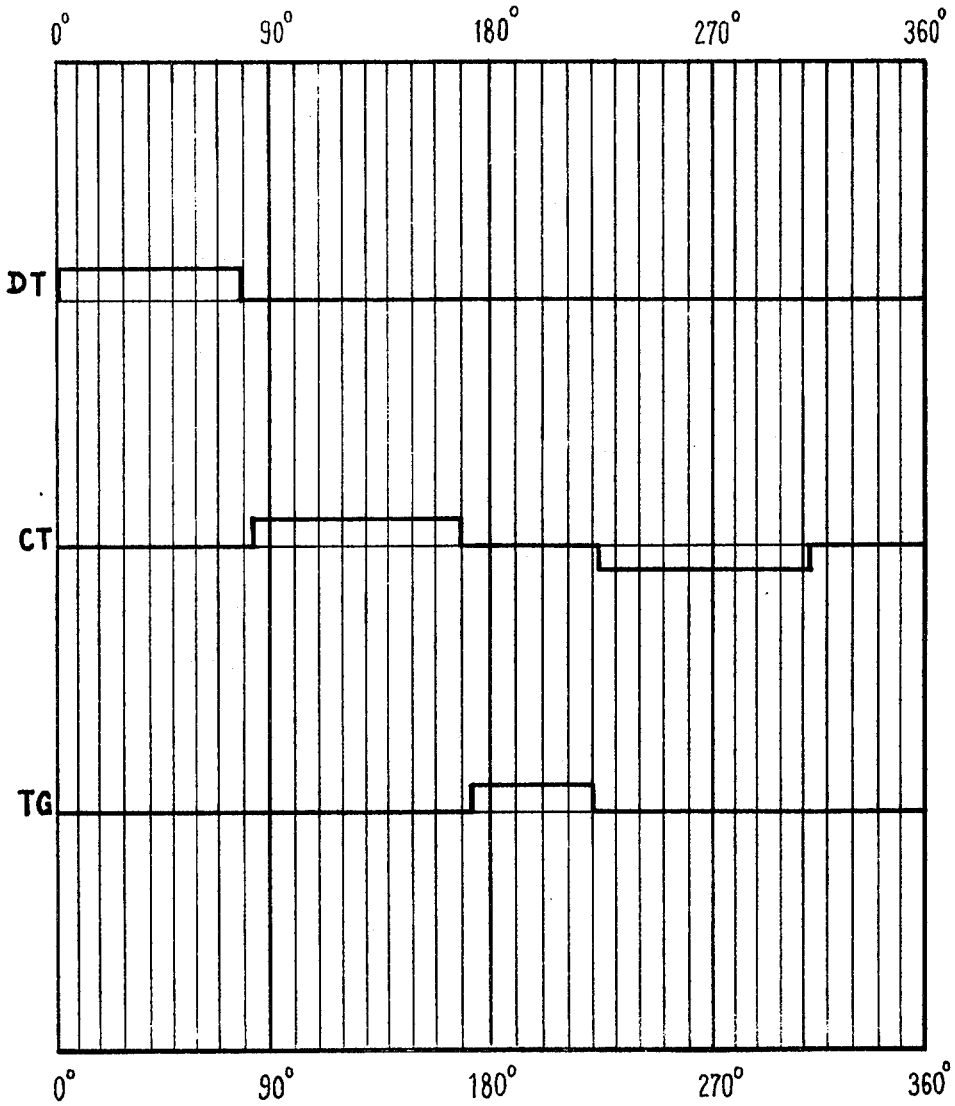
FIG. 5 is a time-phase graph for the moving parts, corresponding to one operating cycle of the new apparatus.

The excitation of the contactor T1 causes its contacts to close and thus it stays self-excited through its contact T1 (1-2), the normally closed contact, M1 (1-2) of the microswitch M1 and the aforementioned contact Pi, while the closing of its other contacts T1 (3–4, 5–6 and 7–8) sets in motion the electric motor MDTCPV for moving the conveyor system DT one step (see first line in FIG. 5). As this movement is taking place but prior to the first full container of cigarettes CP arriving at the transfer station ST between the arms 32 of the transfer contrivance CT, the tripping mechanism of the microswitch M1 is actuated by this first full container of cigarettes CP and this causes the contact M1 (1–2) to open and the other contact M1 (3–4) of the microswitch M1 to close. The opening of the contact M1 (1–2) causes, following a time lag provided by a capacitance *c*, the contactor T1 to be deenergized and, in consequence, the motor MDTCPV and conveyor or system DT to cease operating, while the closing of the contact M1 (3–4) brings about, following a time lag provided by an impedance R, the excitation of the contactor T3 through the contact Pi and the normally closed safety contact T4 (1–2) of the contactor T4.

The excitation of the contactor T3 causes its safety contact T3 (1–2) to open and its other contacts to close and thus it stays self-excited through its contact T3 (3–4), the normally closed contact M2 (1–2) of the microswitch M2 and the safety contact Pi, while through its other contacts T3 (5–6, 7–8 and 9–10), the electric motor MCT is made to start up and to operate the transfer contrivance CT in order to move the container CP located at the station ST in between the arms 32 of the transfer contrivance CT, in the direction of the arrow *f*2 (see FIG. 1) up as far as the rear cavity 13 in the rotatable heat TG where it halts because of the opening, through the feeler 33, of the contact M2 (1–2) of the micro limit switch M2, thereby causing the de-energization of the contactor T3 and, consequently, causing the motor MCT as well as the transfer contrivance CT to come to a halt (FIG. 5, second line).

When the level of the mass of cigarettes to be absorbed by the packeting machine drops down inside the supply hopper T below the ray of light *r*, the latter hits the photoelectric cell *cf* and thus causes the contact 35 of the amplifier 34 to close. The closing of the said contact 35 brings about the excitation of the contactor T2 through the safety contact P*i*. With the energizing of the said contactor T2, its auxiliary contacts close and thus it stays self-excited through its contact T2 (1–2), the normally closed contact M4(1–2) of the microswitch M4 and the contact P*i*, while the closing of its other contacts T2 (3–4, 5–6 and 7–8) causes the electric motor MTG to start up and thereby rotate the head TG 180 degrees in the direction of the arrow *f*3 to reverse the position of the containers located in the two opposite cavities 13 FIG. 5, third line).

At the commencement of this angular displacement on the part of the head TG, the engagement of the idler roller 18 with the fixed rail 19 causes the rear shaft 14 to oscillate and to carry the back square member 16 into its locking position so as to firmly hold the cigarettes in the inside of the container concerned during this angular displacement. When this has ended, oscillation of the arm 22 moves the lever 17 (see FIG. 3) so that back square member 16 is carried, against the restraining action of the springs 20 and 21, into its open position so as to allow the cigarettes to fall out of the container into the hopper T.

Meanwhile, upon completion of the angular displacement of the rotatable head TG, the cyclic cam C trips the operating mechanisms of the microswitch M4, thereby causing its contact M4 (1–2) to open and its other contact M4 (3–4) to close. The opening of the contacts M4 (1–2) of the microswitch M4 results in the contactor T2 being de-energized and, consequently, the electric motor MTG through which the rotation of the rotatable head TG takes place, stopping, while the closing of the contact M4 (3–4) of the microswitch M4 causes the excitation of the contactor T4 through the safety contact Pi and the contacts T3 (1–2) of the contactor T3. The energizing of the said contactor T4 causes its safety contact T4 (1–2) to open and its other contacts T4 (3–4, 5–6, 7–8 and 9–10) to close. The closing of the contacts T4 (3–4) brings about the self-excitation of the contactor T4 through the normally closed contacts M3 (1–2) of the microswitch M3 and the safety contacts Pi, while the closing of the contacts T4 (5–6, 7–8 and 9–10) causes the electric motor MCT to start revolving in the opposite direction to that in which it was formerly operating so as to allow the transfer of the empty container, now held in between the arms 32 of the transfer contrivance CT following a semi-rotation of the rotatable head TG, towards the transfer station ST at the time the full container, which has just been tilted above the supply hopper T, is being emptied therein.

When the empty container reaches the transfer station ST, the contacts M3 (1–2) of the microswitch M3 are opened by means of the feeler 33 and this causes the contactor T4 to be de-energized, the electric motor MCT to therefore stop and thus the arms 32 of the transfer contrivance CT to also come to a standstill, while the contacts M3 (3–4) of the microswitch M3 are closed, thereby bringing about the excitation of the contactor T1, again through the safety contacts P*i*, which gives rise to a repetition of the above described operational cycle.

Should, instead, work be commenced with the apparatus not being in a condition whereby the ray of light *r* is broken by the mass of cigarettes, then the operational cycle starts at the very moment when this particular condition occurs in the previously described cycle.

As can be seen from the preceding description, with an apparatus of this nature, all the objects the invention sets out to achieve are duly realized and, in particular, that pertaining to the supply hoppers on very high output speed packeting machines being uninterruptedly supplied thanks to the empty container being replaced with a full container while a full container is being discharged into the inside of the supply hopper.

I claim

1. Apparatus for transferring cigarettes to an infeed hopper of a cigarette packeting machine, comprising;

a conveyor movable in a succession of longitudinal steps for delivering cigarette containers aligned parallel with one another on and transversely of the conveyor, each container being substantially as wide as each of the cigarettes is long and having an aperture for enabling gravitational discharge of the cigarettes from the container through the aperture;

a rotatable, generally box-shaped head disposed adjacent one side of the conveyor, having two ends, recessed sides therebetween and an axis extending between the two ends, each recessed side defining a cavity receptive, through one of the ends, of one of the cigarette containers and which has a discharge mouth substantially coincident with the aperture of the received container, the discharge mouths being provided opposite one another in respective ones of the cavities;

a fixed structure supporting the head for rotation about said axis;

transfer means for successive pairs of transfer strokes and for transferring in each pair of transfer strokes a container filled with cigarettes from the conveyor into one of the two cavities of the head and a container emptied of cigarettes from the other cavity back to the conveyor;

electromechanical means for synchronously intermittently operating (a) the conveyor to deliver successive filled containers to the transfer means and successive emptied containers from the transfer means, (b) the transfer means itself to perform the successive pairs of transfer strokes, and (c) the rotatable head to alternately position either discharge mouth in a downwardly facing position for discharging cigarettes into an infeed hopper of a cigarette packeting machine; and two back square units on the rotatable head for mechanically opening and closing the discharge mouths, each unit comprising a closure member for selectively opening and closing one of the discharge mouths, arms extending from the closure member to pivot ends, a shaft extending through the pivot ends of the arms and to the ends of the head and pivotally supported on each of those ends, a spring for resiliently biasing the shaft with the arms and the closure member to close the discharge mouth by the closure member, and feeler means disposed at one end of the head, opposite the fixed structure, for mechanically feeling a completion of each successive rotation of the head and the corresponding positioning of either discharge mouth in a downwardly facing position, to rotate the corresponding shaft and arms, against the biasing of the corresponding spring, and thereby to move the respective closure member to open its discharge mouth, the feeler means including two levers, one secured to an end of the shaft of each back square unit, each lever cantilevering from its shaft, opposite one of the ends of the head, and an arcuate guide rail on the fixed structure opposite said one end of the head and concentric with the axis of the head, the guide rail being normally engageable with a free end of each lever and having an end portion disengageable therefrom to enable resilient closing of each discharge mouth by the respective closure member and spring on inception of the next rotation of the head.

2. Apparatus according to claim 1 in which the rotatable head and the electromechanical means for operating it comprise means for effecting the alternate positioning of the head by successive unidirectional rotations.

3. Apparatus according to claim 1 in which one of the two ends of the head has two apertures, each communicating with one of the cavities for reception and return of containers, the feeler means being disposed opposite the other end of the head.

* * * * *